US012037723B2

(12) United States Patent
Park et al.

(10) Patent No.: US 12,037,723 B2
(45) Date of Patent: Jul. 16, 2024

(54) CLOTH FOR MATTRESS AND METHOD FOR MANUFACTURING THE SAME

(71) Applicants: KANEKA CORPORATION, Osaka (JP); DITGREEN CO., LTD., Daejeon (KR)

(72) Inventors: Soon-Yong Park, Daejeon (KR); Hyo-Sup Chang, Daejeon (KR); Woo-Hyung Lee, Daejeon (KR); Mi-Young Jung, Daejeon (KR); Tatsuro Ohzeki, Hyogo (JP)

(73) Assignees: KANEKA CORPORATION, Osaka (JP); DITGREEN CO., LTD., Daejeon (KR)

( * ) Notice: Subject to any disclaimer, the term of this patent is extended or adjusted under 35 U.S.C. 154(b) by 141 days.

(21) Appl. No.: 17/901,076

(22) Filed: Sep. 1, 2022

(65) Prior Publication Data

US 2023/0019403 A1 Jan. 19, 2023

Related U.S. Application Data

(63) Continuation of application No. PCT/JP2021/006791, filed on Feb. 24, 2021.

(30) Foreign Application Priority Data

Mar. 10, 2020 (KR) ..... 10-2020-0029592

(51) Int. Cl.

| | |
|---|---|
| ***D04B 1/16*** | (2006.01) |
| ***D04B 21/16*** | (2006.01) |
| ***D04B 21/18*** | (2006.01) |
| *D03D 15/513* | (2021.01) |

(52) U.S. Cl.

CPC ..... *D04B 1/16* (2013.01); *D04B 21/16* (2013.01); *D04B 21/18* (2013.01); *D03D 15/513* (2021.01)

(58) Field of Classification Search

CPC ..... D04B 21/16; D04B 21/18; D04B 1/12; D04B 1/14; D04B 1/16; D04B 1/18; D04B 1/20; D03D 15/513; D10B 2321/101; D10B 2505/08

USPC ..... 66/202

See application file for complete search history.

(56) References Cited

U.S. PATENT DOCUMENTS

| | | | | |
|---|---|---|---|---|
| 10,492,620 | B2 * | 12/2019 | Moore, III | D04H 1/435 |
| 2004/0060119 | A1 | 4/2004 | Murphy et al. | |
| 2004/0198125 | A1 * | 10/2004 | Mater | D04H 1/43828 442/394 |
| 2004/0219852 | A1 * | 11/2004 | Eichhorn | D02G 3/443 428/920 |
| 2005/0023509 | A1 | 2/2005 | Bascom et al. | |
| 2006/0090272 | A1 | 5/2006 | Mio et al. | |
| 2006/0234592 | A1 * | 10/2006 | Mio | D04H 1/43 428/920 |
| 2008/0157036 | A1 | 7/2008 | Ogawa et al. | |
| 2009/0311933 | A1 | 12/2009 | Mihoichi et al. | |
| 2010/0029156 | A1 | 2/2010 | Tanaka et al. | |
| 2022/0361685 | A1 * | 11/2022 | Park | A47C 31/001 |
| 2023/0270194 | A1 * | 8/2023 | Ohno | A41D 31/08 2/458 |

FOREIGN PATENT DOCUMENTS

| | | | | |
|---|---|---|---|---|
| EP | 1842957 | A1 | 10/2007 | |
| EP | 3009547 | A1 * | 4/2016 | D02G 3/44 |
| JP | 2007105403 | A * | 4/2007 | |
| JP | 2020002475 | A * | 1/2020 | |
| KR | 2006-0066073 | A | 6/2006 | |
| KR | 10-2007-0091618 | A | 9/2007 | |
| KR | 101308982 | B1 | 9/2013 | |
| WO | 2005012617 | A1 | 2/2005 | |
| WO | WO-2009038602 | A1 * | 3/2009 | D02G 3/443 |

OTHER PUBLICATIONS

International Search Report issued in corresponding International Application No. PCT/JP2021/006791, mailed May 25, 2021 (3 pages).

Written Opinion issued in corresponding International Application No. PCT/JP2021/006791, mailed May 25, 2021 (3 pages).

* cited by examiner

*Primary Examiner* — Danny Worrell

(74) *Attorney, Agent, or Firm* — Osha Bergman Watanabe & Burton LLP

(57) ABSTRACT

A cloth for mattress including a knitted fabric that is knitted from blended yarns contains flame retardant rayon fibers, modacrylic fibers, polyimide fibers, and low-melting polyester fibers. The cloth for mattress can be obtained by producing blended yarns containing the flame retardant rayon fibers, the modacrylic fibers, the polyimide fibers, and the low-melting polyester fibers, and producing a knitted fabric by knitting the blended yarns. The cloth for mattress has excellent flame retardancy, ensures easy handling when used to cover a mattress, is resistant to pilling without reducing the strength of the blended yarns, and is also safe for contact with the human body.

18 Claims, No Drawings

CLOTH FOR MATTRESS AND METHOD FOR MANUFACTURING THE SAME

TECHNICAL FIELD

One or more embodiments of the present invention relate to a cloth for mattress that includes flame retardant blended yarns and a method for manufacturing the cloth for mattress.

BACKGROUND

A mattress is generally placed on a bed frame of a bed used in each home and enables people to have comfortable sleep and rest. The mattress includes a tension member that has a tension strength and a cover member that covers the outer surfaces of the tension member.

In general, the mattress has basic performance, including heat insulation properties, breathability, restorability, and durability with which the volume of the mattress can be maintained even after it has been used for a long time. In other words, the mattress needs to have the heat insulation properties for keeping the body temperature of the user, to allow air to flow smoothly through it, and also to be able to shrink and restore its volume properly in response to the load of the user.

The mattress is usually rectangular in shape and typically includes a core, an upholstery material, and a cover. The core has the most significant effect on the feel of the mattress and is made of materials such as spring, latex, and memory foam (registered trademark). The upholstery material is placed between the core and the cover and performs various functions of the mattress. The cover comes into direct contact with the body.

The upholstery material and the cover may affect the human body and therefore pursue antibacterial properties, bactericidal action, and deodorant function. This does not cause any inconvenience when the mattress is used. However, if an unexpected fire broke out during the use of the mattress and the mattress caught fire, the upholstery material and the cover would burn easily because both of them are made of a simple fiber material. In addition, a poisonous gas or the like that is harmful to the human body may be generated while the mattress is burning. Consequently, the fire may be larger and the human damage may be more serious.

The upholstery material and the cover are usually produced by stacking a nonwoven fabric, padding, and a cloth in this order from the inside to the outside, and then forming the layered materials into a single unit with any known quilting technique. These materials used for the upholstery material and the cover have been identified as the main reason for the spread of a mattress fire.

Thus, various fiber materials for mattresses should have flame retardancy or flameproofness.

Fiber products made of materials with excellent heat resistance such as glass fibers and aramid fibers have been used mainly for flame retardant or flameproof fibers. In this case, although the function of flame retardancy or flameproofness can be ensured, the fiber products still do not have enough properties for mattresses such as affinity for the human body, texture, resilience, softness, and stretchability, and thus are not suitable as materials for bedding.

PRIOR ART DOCUMENTS

Patent Document 1: KR 2006-0066073 A (SINGLE LAYER FIREBLOCKING FABRIC FOR A MATTRESS OR MATTRESS SET AND PROCESS TO FIREBLOCK SAME)

SUMMARY

One or more embodiments of the present invention are to provide a cloth for mattress that has flameproofness and a function suitable for materials for bedding, and a method for manufacturing the cloth for mattress.

One or more embodiments of the present invention relate to a cloth for mattress including a knitted fabric that is knitted from blended yarns containing 20 to 70% by weight of flame retardant rayon fibers, 10 to 30% by weight of modacrylic fibers, 10 to 30% by weight of polyimide fibers, and 5 to 20% by weight of low-melting polyester fibers. The polyimide fibers have 3 to 12 crimps per inch. The pilling resistance of the cloth for mattress, measured in accordance with KS K 0503:2006, is rated grade 4 to 5 or higher, where the number of revolutions is set to 14400.

One or more embodiments of the present invention relate to a method for manufacturing a cloth for mattress. The method includes spinning fibers composed of 20 to 70% by weight of flame retardant rayon fibers, 10 to 30% by weight of modacrylic fibers, 10 to 30% by weight of polyimide fibers, and 5 to 20% by weight of low-melting polyester fibers into blended yarns, and knitting the blended yarns into a knitted fabric. The polyimide fibers have 3 to 12 crimps per inch.

The cloth for mattress of one or more embodiments of the present invention has excellent flame retardancy due to the combination of the flame retardant fiber materials. Since the blended yarns are knitted into a fabric without reducing the strength and the knitting workability, the cloth for mattress is highly stretchable and ensures easy handling when used to cover a mattress. Moreover, the cloth for mattress is resistant to pilling and is also safe for contact with the human body.

DETAILED DESCRIPTION

The present inventors conducted many studies to solve the above. As a result, the present inventors found that a cloth for mattress including a particular knitted fabric was able to have excellent flameproofness, to be resistant to pilling, and to be safe for contact with the human body. The knitted fabric was produced by combining the predetermined amounts of different fibers, including polyimide fibers with a predetermined number of crimps, flame retardant rayon (FR-rayon) fibers, modacrylic fibers, and low-melting polyester (LM PET) fibers, into blended yarns and then knitting the blended yarns.

Specifically, the blended yarns have a combination of the polyimide fibers with a predetermined number of crimps and the low-melting polyester fibers in addition to the flame retardant fibers (i.e., the flame retardant rayon fibers and the modacrylic fibers). Therefore, carbonized layers of the polyimide fibers and the low-melting polyester fibers are formed when the knitted fabric is burned, and the carbonized layers will impede the progress of burning, resulting in a significant improvement in flameproofness.

In general, the polyimide fibers are not easily mixed with other fibers because they have a smooth surface and a high elongation. One or more embodiments of the present invention use the polyimide fibers with a predetermined number of crimps to prevent the polyimide fibers from falling off the blended yarns and to reduce the occurrence of a pilling phenomenon. This will help the polyimide fibers to have the effect of improving the flameproofness.

Moreover, the low-melting polyester fibers can enhance the binding between the fibers in the blended yarns and effectively reduce the pilling phenomenon that is likely to be caused by the modacrylic fibers and the polyimide fibers.

In one or more embodiments of the present invention, the cloth for mattress includes a knitted fabric that is knitted from blended yarns containing 20 to 70% by weight of flame retardant rayon fibers, 10 to 30% by weight of modacrylic fibers, 10 to 30% by weight of polyimide fibers, and 5 to 20% by weight of low-melting polyester fibers.

In one or more embodiments of the present invention, the cloth for mattress is manufactured by spinning fibers composed of flame retardant rayon fibers, modacrylic fibers, polyimide fibers, and low-melting polyester fibers into blended yarns, and knitting the blended yarns into a knitted fabric.

In one or more embodiments of the present invention, the blended yarns contain 20 to 70% by weight of flame retardant rayon fibers, 10 to 30% by weight of modacrylic fibers, 10 to 30% by weight of polyimide fibers, and 5 to 20% by weight of low-melting polyester (LM PET) fibers.

Rayon is used for various purposes such as outer lining and underwear. Rayon is a fiber material that is excellent in antistatic function and texture, and that can avoid any inconvenience to the user due to static electricity.

The flame retardant rayon fibers are obtained by imparting flame retardancy to rayon fibers. For example, the flame retardant rayon fibers may be obtained by adding a phosphorus-based flame retardant to the spinning process so that the rayon fibers are modified. The flame retardant rayon fibers have washing durability and dyeability as well as flame retardancy. It is preferable that the flame retardant rayon fibers have a fineness of 2 to 5 d (denier).

If the content of the frame retardant rayon fibers in the blended yarns is less than 20% by weight, flexibility and resilience are reduced. If the content of the flame retardant rayon fibers is more than 70% by weight, flame retardancy is reduced because the fire that has spread to the cloth for mattress will not be extinguished immediately even though the cause of the fire is easily eliminated.

The modacrylic fibers are acrylic synthetic fibers made from a polymer that mainly contains acrylonitrile. The polymer may be a copolymer containing 30 to 70% by weight of acrylonitrile and 30 to 70% by weight of halogen-containing vinyl monomer. The halogen-containing vinyl monomer may be at least one monomer selected from, e.g., vinyl chloride, vinylidene chloride, vinyl bromide, or vinylidene bromide. Examples of the copolymerizable vinyl monomer include acrylic acid, methacrylic acid, salts or esters of these acids, acrylamide, methylacrylamide, and vinyl acetate.

The modacrylic fibers may be composed of a copolymer of acrylonitrile and vinylidene chloride. The copolymer may further contain one or more antimony oxides to improve the flame retardancy.

The modacrylic fibers produce a flame retardant gas that serves as a barrier to oxygen when the knitted fabric is burned. However, they also produce a considerable amount of acid gas.

The modacrylic fibers themselves have excellent strength, resilience, flameproofness, and chemical resistance. Moreover, the modacrylic fibers are relatively inexpensive compared to other flame retardant fibers and widely used for, e.g., work clothes, flame retardant laboratory clothes, carpets, and curtains. However, the modacrylic fibers are likely to fade in the sunlight, have poor dyeability, and become less stretchable once they are dyed. There are some restrictions on the use of the modacrylic fibers alone.

If the content of the modacrylic fibers in the blended yarns is less than 10% by weight, the generation of the flame retardant gas is decreased during burning, which reduces flame retardancy and flameproofness (flame resistance). The flame retardant gas is heavier than air and blocks the contact between a combustible material and oxygen. If the content of the modacrylic fibers is more than 30% by weight, thermal resistance is reduced, char length is increased, and a large amount of toxic smoke is emitted during burning. The toxic smoke may cause pollution and be harmful to the human body. Moreover, pilling occurs significantly, leading to poor knittability and napping on the surface of the cloth.

The polyimide fibers are decomposed at a temperature of 450° C. or more, and thus have high heat resistance, excellent heat shielding properties, and thermal stability. The polyimide fibers are also chemically resistant to acids and alkalis and have good strength.

The presence of the polyimide fibers in the blended yarns improves the thermal stability, the heat shielding properties, and the dimensional stability. Therefore, the carbonization of the knitted fabric made of the blended yarns of one or more embodiments of the present invention proceeds more quickly, thereby improving the flame retardancy and flameproofness of the knitted fabric.

On the other hand, polyimide with high thermal resistance functions as a flexible stiffener in carbonized layers and protects the carbonized layers from damage. This can inhibit further burning of the knitted fabric and reduce the char length.

The carbonized layers are firmly held and ensure that a flame or heat will no longer be transferred to the inside of the knitted fabric so as to prevent the knitted fabric from burning further.

If the content of the polyimide fibers in the blended yarns is less than 10% by weight, thermal characteristics are reduced, the carbonized portion is increased, and burning is not stopped immediately. If the content of the polyimide fibers is more than 30% by weight, spinnability is reduced, the effect is only slightly improved, and the knitted fabric is not economically desirable.

The low-melting polyester (LM PET) fibers have a melting point of 150 to 200° C. and performs the function of fusion when melted in this temperature range.

The low-melting polyester fibers may be melted to serve as an adhesive when heat is applied to the blended yarns or the knitted fabric made of the blended yarns for processing. Therefore, the use of the low-melting polyester fibers can improve the mechanical strength and durability of the blended yarns and reduce the occurrence of pilling, which is a disadvantage of spun yarns.

When the knitted fabric is burned, the low-melting polyester fibers are first melted and subjected to a thermal decomposition to form carbonized layers in the knitted fabric. The carbonized layers can reduce the shrinkage of the knitted fabric and fill the gaps in the knitted fabric. Thus, the formation of the carbonized layers can improve the flame retardancy and flameproofness of the knitted fabric.

The individual fibers constituting the blended yarns differ from each other in the rate of shrinkage. Therefore, the contact between the fibers may be reduced in various processes of producing the cloth for mattress. In such a case, since the LM PET fibers are configured to bind these fibers together, the contact between the fibers, the mechanical strength, and the durability can be improved.

If the content of the low-melting polyester fibers in the blended yarns is less than 5% by weight, the knitted fabric develops pilling and may have poor mechanical strength and durability. If the content of the low-melting polyester fibers is more than 20% by weight, the cloth for mattress becomes hard due to thermal fusion and shrinks by heat, causing a sudden reduction in flame retardancy and flameproofness.

If the melting point of the low-melting polyester fibers is less than 150° C., the fiber properties may be reduced and the desorption of the fibers may occur in a wet heat treatment (as will be described later) in the manufacturing process of the cloth for mattress.

In one or more embodiments of the present invention, the blended yarns may be produced in the following manner. For example, staple fibers of the flame retardant rayon fibers, the modacrylic fibers, the polyimide fibers, and the low-melting polyester fibers may be mixed and spun together. Alternatively, each of these fibers may be formed into a sliver, and then the resulting slivers may be combined. Further, one type of sliver may be wrapped with other spun yarns. These methods may be combined as appropriate.

The individual staple fibers of the flame retardant rayon fibers, the modacrylic fibers, the polyimide fibers, and the low-melting polyester fibers may have a fineness of 2 to 5 d and a length of 37 to 127 mm. This configuration can facilitate spinning and improve the tensile strength of the blended yarns while maintaining their flexibility. Thus, the knitted fabric can have not only stretchability and resilience, but also high mechanical strength.

If the fineness of the staple fibers is less than 2 d, the mechanical strength is reduced. If the fineness of the staple fibers is more than 5 d, the number of the staple fibers in the blended yarns is reduced, which in turn reduces the mechanical strength, processability, and flexibility of the blended yarns.

If the length of the staple fibers is less than 37 mm, the mechanical strength is reduced. If the length of the staple fibers is more than 127 mm, the mechanical strength is increased, while the spinnability is reduced.

In general, spun yarns are produced by mixing two or more types of staple fibers. In this case, due to the different properties of the constituent fibers, the individual constituent fibers cannot fully exhibit their mechanical properties during the processing such as mixing and spinning.

Polyimide staple fibers are characterized by a smooth surface, a low modulus, and a high elongation. The polyimide staple fibers are not suitable for the reinforcement of other fibers.

In one or more embodiments of the present invention, the polyimide staple fibers may have 3 to 12 crimps per inch. With this configuration, even if a small amount of the polyimide staple fibers is mixed in spinning, the blended yarns can incorporate the properties of the polyimide staple fibers so that the required properties of the blended yarns are not reduced. If the number of crimps of the polyimide staple fibers is less than 3 crimps per inch, the fibers become less flexible and may slip out of the blended yarns. Consequently, the knitted fabric may develop pilling or cause itching to the skin. If the number of crimps of the polyimide staple fibers is more than 12 crimps per inch, the fibers are bent and may have poor mechanical strength.

The polyimide fibers may be fibrillated by friction that would occur between the fibers and the machine or the like during the processing. Thus, the polyimide fibers are likely to fall off during the processing.

The blended yarns may have a count of 5 to 30 and 10 to 20 twists per inch. With this configuration, the mechanical strength of the blended yarns is not reduced, the staple fibers are prevented from falling off the blended yarns, and the knittability is not degraded.

The blended yarns are not particularly limited, and may have a strength (tensile strength) of more than 1.29 cN/dtex, 1.35 cN/dtex or more, or 1.40 cN/dtex or more, from the viewpoint of improving the mechanical strength.

The fabric used as the cloth for mattress may be produced by knitting the blended yarns into any type of knitted fabric such as a weft knitted fabric, a circular knitted fabric, or a warp knitted fabric.

When the cloth for mattress includes a woven fabric, the woven fabric has a structure in which weft threads and warp threads intersect at crossover points. This structure makes it difficult for each thread to move freely. Therefore, the woven fabric cannot achieve a sufficient elongation unless the original yarns have good stretchability.

On the contrary, the knitted fabric has a structure in which loops of the original yarns are interlocked with each other. There is no crossover point, and the original yarns can move freely. Moreover, the connections of loops can be deformed in the direction of the applied force. Thus, the knitted fabric is far superior in elongation to the woven fabric.

The cloth for mattress of one or more embodiments of the present invention is highly stretchable and ensures easy handling when used to cover the core of a mattress.

The knitted fabric may have a weight per unit area of 200 to 500 g/m$^2$. This configuration can combine lightweight with mechanical strength and durability.

To produce the cloth for mattress, the knitted fabric may be heat treated so that the low-melting polyester fibers are fused. The heat treatment can be performed by using, e.g., a tenter. The knitted fabric may be subjected to a dry heat treatment at 150 to 180° C. As a result, the low-melting polyester fibers are fused to increase the bonding strength of the fibers constituting the blended yarns. Therefore, it is possible to improve the binding between the fibers in the blended yarns and to easily reduce the occurrence of pilling. Specifically, the knitted fabric may be subjected to a dry heat treatment at 150 to 180° C. for 1 to 10 minutes by using a tenter.

The tenter is generally and widely used as a machine for heat-setting of cloth in order to adjust the cloth according to its intended use and specification. The role of the tenter is to improve the stretchability of the cloth. For this purpose, heat is applied to the fiber cloth under the conditions in which the temperature and the air flow are set for each chamber and the speed of treatment is controlled. Thus, the treated cloth can maintain excellent flame retardancy and stretchability.

In one or more embodiments of the present invention, the blended yarns or the knitted fabric may be subjected to a wet heat treatment at 130 to 145° C. for 10 to 90 minutes in a high humidity atmosphere. Then, the knitted fabric may be further subjected to a dry heat treatment at 150 to 180° C. for 1 to 10 minutes in the tenter.

In such a case, the wet heat treatment may be performed using high pressure steam in an autoclave or may be performed by a high pressure dyeing machine.

Even if the blended yarns develop pilling, the pilling can easily be removed by the wet heat treatment. Moreover, the low-melting polyester fibers are fused by the dry heat treatment. Therefore, the constituent fibers do not easily fall off the blended yarns, and the occurrence of pilling can be reduced.

In the cloth for mattress of one or more embodiments of the present invention produced by the method as described above, the presence of the polyimide fibers reduces the generation of toxic gas and the char length, and thus can improve the flame retardancy and flameproofness of the cloth for mattress. Further, the presence of the low-melting polyester fibers increases the bonding strength of the fibers constituting the blended yarns, and thus can improve the mechanical strength and durability of the blended yarns and reduce the occurrence of pilling, which is a disadvantage of spun yarns.

On the other hand, the presence of the polyimide staple fibers having 3 to 12 crimps per inch improves the processability of the fibers during the processing in the manufacture of the blended yarns and the knitted fabric. Thus, the properties of the fiber products can be improved.

In terms of excellent pilling resistance, it is preferable that the pilling resistance of the cloth for mattress, measured in accordance with KS K 0503:2006, is rated grade 4 to 5 or higher, where the number of revolutions is set to 14400.

In terms of excellent flameproofness, it is preferable that the carbonized area and the char length of the cloth for mattress, both measured in accordance with the Korean standard of flame retardant performance KOFEIS 1001, are 20 $cm^2$ or less and 8 cm or less, respectively.

In terms of excellent flameproofness, it is preferable that the afterflame time and the afterglow time of the cloth for mattress, both measured in accordance with the Korean standard of flame retardant performance KOFEIS 1001, are 0 second and 0 second, respectively.

In terms of excellent handleability of the cloth for mattress when it is used to cover a mattress, it is preferable that both the elongation recovery rate of the cloth for mattress in the warp direction and the elongation recovery rate of the cloth for mattress in the weft direction are 90% or more.

EXAMPLES

Hereinafter, one or more embodiments of the present invention will be described in more detail based on the following Examples and Comparative Examples.

The following examples are given for illustrative purpose only and should not be construed to limit the scope of one or more embodiments of the present invention. It is obvious to those having ordinary skill in the art to which one or more embodiments of the present invention pertain that any replacement and modification to other equivalent examples can be made without departing from the technical idea of one or more embodiments of the present invention.

Example 1

Materials composed of 60% by weight of flame retardant rayon staple fibers (2d×51 mm), 10% by weight of modacrylic staple fibers (3d×51 mm), 10% by weight of polyimide staple fibers (2d×51 mm, 8 crimps per inch), and 20% by weight of LM PET staple fibers (2d×51 mm) with a melting point of 150° C. were mixed in a blowing process. Then, the mixture of the materials was subjected to a spinning process through carding, drawing, roving, and fine spinning. Thus, blended yarns were produced that had a count of 10 and 12 twists per inch.

The blended yarns were knitted to form a warp knitted structure by using a tricot machine. Thus, a knitted fabric of 250 $g/m^2$ was produced.

The knitted fabric was treated in a tenter at 180° C. for 3 minutes, resulting in a cloth for mattress.

A sample of 6 cm (width)×25 cm (length) was taken from the cloth for mattress thus obtained. Then, the central portion of the width of the sample was clamped between jaws, each having a width of 2.5 cm. The length was set to 15 cm and the tensile speed was set to 15 cm/min. Under these conditions, the sample was pulled by using a TENSILON tensile tester until a stress of 4.9 N/cm was applied to the sample. Subsequently, the sample was restored with the same speed to the position at which the displacement was zero. In this manner, the elongation rate was measured.

The elongation recovery rate was calculated by the following formula 1.

$$\text{Elongation recovery rate (\%)}=(L_1-L_0)\times 100, \quad \text{[Formula 1]}$$

where $L_1$ represents the length (cm) of elongation under 4.9 N/cm, and $L_0$ represents the length (cm) from the origin at the time the stress was zero after recovery.

The measurement results showed that the elongation rate was 21% and the elongation recovery rate was 95% in the warp direction, and that the elongation rate was 83% and the elongation recovery rate was 91% in the weft direction.

This example confirmed that the cloth for mattress was easy to cover the core of a mattress because of its excellent elongation properties, as described above.

Example 2

A cloth for mattress was produced in the same manner as Example 1 except that the blended yarns in the cheese form were subjected to a wet heat treatment at 140° C. for 30 minutes before they were knitted into a fabric in Example 1.

Comparative Examples 1 to 6

A cloth for mattress was produced in the same manner as Example 1 except that the contents of the staple fibers in the blended yarns and the number of crimps of the polyimide staple fibers in Example 1 were changed as shown in Table 1 below.

TABLE 1

| Category | | Ex. 1 | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Composition of blended yarn (% by weight) | FR rayon fibers | 60 | 70 | 45 | 70 | 55 | 60 | 60 |
| | Modacrylic fibers | 10 | 15 | 10 | 15 | 10 | 10 | 10 |
| | PI fibers | 10 | 5 | 35 | 15 | 10 | 10 | 10 |
| | LM PET fibers | 20 | 10 | 10 | 0 | 25 | 20 | 20 |
| Number of crimps | PI staple fibers | 8 | 8 | 8 | 8 | 8 | 2 | 15 |

The flameproofness of the cloths for mattress in Examples and Comparative Examples was measured by the following method. Table 2 shows the results.

In this case, the flameproof performance measurement experiments were performed in accordance with the Korean standard of flame retardant performance KOFEIS 1001.

TABLE 2

| Category | Criteria | Ex. 1 | Comp. Ex. 1 | Comp. Ex. 2 | Comp. Ex. 3 | Comp. Ex. 4 |
|---|---|---|---|---|---|---|
| Afterflame time (sec) | 3 sec or less | 0 | 0 | 0 | 0 | 1 |
| Afterglow time (sec) | 5 sec or less | 0 | 0 | 0 | 0 | 1 |
| Carbonized area ($cm^2$) | 30 $cm^2$ or less | 17.2 | 28.8 | 17.1 | 21.6 | 36.8 |
| Char length (cm) | 20 cm or less | 5.4 | 10.1 | 5.4 | 8.7 | 21.4 |

Table 3 shows the properties of the blended yarns in Examples and Comparative Examples.

TABLE 3

| Category | | Ex. 1 | Comp. Ex. 5 | Comp. Ex. 6 |
|---|---|---|---|---|
| Properties of blended yarns | Fineness (count) | 10 | 10 | 10 |
| | Tenacity (N) | 1.42 | 1.38 | 1.29 |
| | Strength (cN/dtex) | 1.42 | 1.38 | 1.29 |
| | Elongation (%) | 4.9 | 4.7 | 4.9 |

The pilling resistance of the cloths for mattress in Examples and Comparative Examples was measured in accordance with KS K 0503:2006, where the number of revolutions was set to 14400.

Table 4 shows the results.

TABLE 4

| | Ex. 1 | Ex. 2 | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Pilling resistance (grade) | grade 4 to 5 | grade 5 | grade 4 | grade 3 to 4 | grade 3 to 4 | grade 4 to 5 | grade 3 to 4 | grade 4 |

The above evaluation results confirm that the cloth for mattress of one or more embodiments of the present invention has excellent flameproofness, ensures easy handling when used to cover a mattress, is resistant to pilling without reducing the strength of the blended yarns, and is also safe for contact with the human body.

Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

The invention claimed is:

1. A cloth for mattress comprising:

a knitted fabric that is knitted from blended yarns comprising 20 to 70% by weight of flame retardant rayon fibers, 10 to 30% by weight of modacrylic fibers, 10 to 30% by weight of polyimide fibers, and 5 to 20% by weight of low-melting polyester fibers, wherein:

the polyimide fibers have 3 to 12 crimps per inch, and pilling resistance of the cloth for mattress, measured in accordance with KS K 0503:2006, is rated grade 4 to 5 or higher, where a number of revolutions is set to 14400.

2. The cloth for mattress according to claim 1, wherein the flame retardant rayon fibers, the modacrylic fibers, the polyimide fibers, and the low-melting polyester fibers have a fineness of 2 to 5 d and a length of 37 to 127 mm.

3. The cloth for mattress according to claim 2, wherein a carbonized area and a char length of the cloth for mattress, both measured in accordance with Korean standard of flame retardant performance KOFEIS 1001, are 20 $cm^2$ or less and 8 cm or less, respectively.

4. The cloth for mattress according to claim 2, wherein afterflame time and afterglow time of the cloth for mattress, both measured in accordance with Korean standard of flame retardant performance KOFEIS 1001, are 0 second and 0 second, respectively.

5. The cloth for mattress according to claim 2, wherein both an elongation recovery rate of the cloth for mattress in a warp direction and an elongation recovery rate of the cloth for mattress in a weft direction are 90% or more.

6. The cloth for mattress according to claim 2, wherein the blended yarns have a strength of more than 1.29 cN/dtex.

7. The cloth for mattress according to claim 1, wherein a carbonized area and a char length of the cloth for mattress, both measured in accordance with Korean standard of flame retardant performance KOFEIS 1001, are 20 $cm^2$ or less and 8 cm or less, respectively.

8. The cloth for mattress according to claim 1, wherein afterflame time and afterglow time of the cloth for mattress, both measured in accordance with Korean standard of flame retardant performance KOFEIS 1001, are 0 second and 0 second, respectively.

9. The cloth for mattress according to claim 1, wherein both an elongation recovery rate of the cloth for mattress in a warp direction and an elongation recovery rate of the cloth for mattress in a weft direction are 90% or more.

10. The cloth for mattress according to claim 1, wherein the blended yarns have a strength of more than 1.29 cN/dtex.

11. A method for manufacturing a cloth for mattress, the method comprising:

spinning fibers composed of 20 to 70% by weight of flame retardant rayon fibers, 10 to 30% by weight of modacrylic fibers, 10 to 30% by weight of polyimide fibers, and 5 to 20% by weight of low-melting polyester fibers into blended yarns; and knitting the blended yarns into a knitted fabric, wherein the polyimide fibers have 3 to 12 crimps per inch.

12. The method according to claim 11, wherein the blended yarns have a strength of more than 1.29 cN/dtex.

13. The method according to claim 11, wherein the knitted fabric is subjected to a dry heat treatment at 150 to 180° C.

14. The method according to claim 13, wherein the blended yarns have a strength of more than 1.29 cN/dtex.

15. The method according to claim 11, wherein the flame retardant rayon fibers, the modacrylic fibers, the polyimide fibers, and the low-melting polyester fibers have a fineness of 2 to 5 d and a length of 37 to 127 mm.

16. The method according to claim 15, wherein the blended yarns have a strength of more than 1.29 cN/dtex.

17. The method according to claim 15, wherein the knitted fabric is subjected to a dry heat treatment at 150 to 180° C.

18. The method according to claim 17, wherein the blended yarns have a strength of more than 1.29 cN/dtex.

* * * * *